US006925736B2

(12) United States Patent
Taki

(10) Patent No.: US 6,925,736 B2
(45) Date of Patent: Aug. 9, 2005

(54) IN SITU MIXING APPARATUS AND METHODS FOR CREATING UNDERGROUND WALL

(76) Inventor: Osamu Taki, 2558 Somerset Dr., Belmont, CA (US) 94002

( * ) Notice: Subject to any disclaimer, the term of this patent is extended or adjusted under 35 U.S.C. 154(b) by 116 days.

(21) Appl. No.: 10/278,105

(22) Filed: Oct. 21, 2002

(65) Prior Publication Data

US 2003/0046835 A1 Mar. 13, 2003

Related U.S. Application Data

(63) Continuation of application No. 09/632,533, filed on Aug. 4, 2000, now Pat. No. 6,470,607.

(51) Int. Cl.[7] ..... E02F 5/00
(52) U.S. Cl. ..... 37/352; 37/356
(58) Field of Search ..... 299/80.1–80.4, 299/84.1–84.3, 18, 64, 76, 80, 84; 37/352–362, 464, 463; 172/100

(56) References Cited

U.S. PATENT DOCUMENTS

| | | | |
|---|---|---|---|
| 3,754,341 | A | 8/1973 | Caldwell et al. |
| 4,223,462 | A | 9/1980 | Morris |
| 4,843,742 | A | 7/1989 | Camilleri |
| 5,228,220 | A | 7/1993 | Bryan, Jr. |
| 5,244,315 | A | 9/1993 | Kitanaka et al. |
| 5,311,683 | A | 5/1994 | Camilleri |
| 5,349,765 | A | 9/1994 | Kitahaka et al. |
| 5,497,567 | A | 3/1996 | Gilbert |

FOREIGN PATENT DOCUMENTS

| | | | |
|---|---|---|---|
| JP | H5-280043 | A | 10/1993 |
| JP | H5-280044 | A | 10/1993 |

OTHER PUBLICATIONS

"Pedestrian Bridge Foundation in Foster City, CA," Geo–Column Newsletter, Oct. 1999, SCC Technology, Inc. of Belmont, CA.
"Bridge Foundation in Crissy Field, San Francisco", Geo–Column Newsletter, Jul. 1999, SCC Technology, Inc. of Belmont, CA.
Advertising, "Hardhat," Oct. 1999, pp. 83–84.
Advertising, "Rock & Dirt," Oct. 1999, pp. 53–54.
Brochure, Tomen Kenki, TRD–10 TRD–25, no date.

*Primary Examiner*—Robert E Pezzuto
(74) *Attorney, Agent, or Firm*—Fenwick & West LLP

(57) ABSTRACT

Methods and apparatuses are provided for constructing an underground wall in a trench, include using multiple chains on an endless chain cutter and individually controlling the speed and/or direction of the chains, various configurations of cutter bits and agitator bars on the chains, a technique for assembling the endless chain cutter in a horizontal position outside of a starter trench, then erecting the endless chain cutter to a vertical position in the starter trench. A guide frame straddles the starter trench. The endless chain cutter is repeatedly moved within the guide frame, then the guide frame is re-positioned until the entire length of the trench has been excavated. A central portion of the trench may be cut deeper than outer portions to create interlocking joints between adjacent wall sections and added stability for the resulting wall. Side gap barriers seal gaps between the sides of the endless chain cutter and side walls of the trench. A base machine, such as a common backhoe, may be used to dig the starter trench, to push the endless chain cutter into the starter trench and erected it to a vertical position to re-position the guide frame, and to de-erect the endless chain cutter from its vertical position and remove it from the trench.

22 Claims, 10 Drawing Sheets

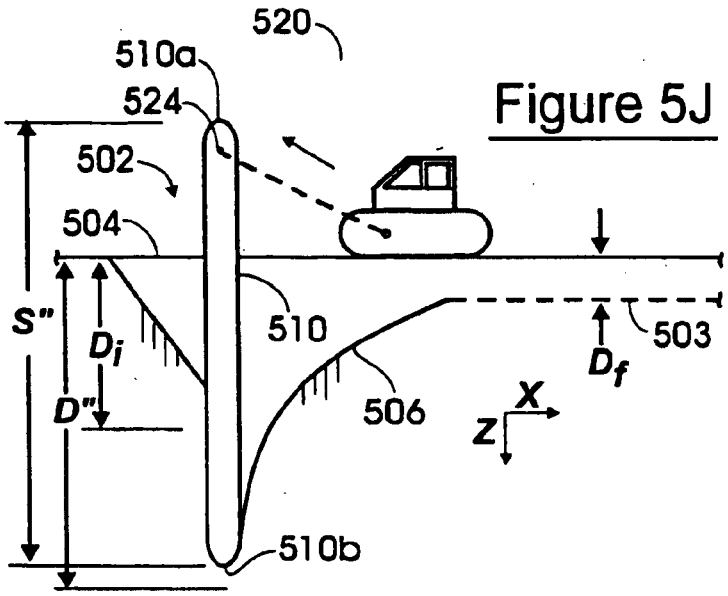
Figure 5J
Figure 5L
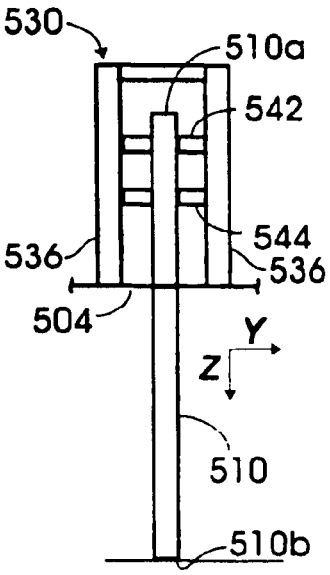
Figure 5K
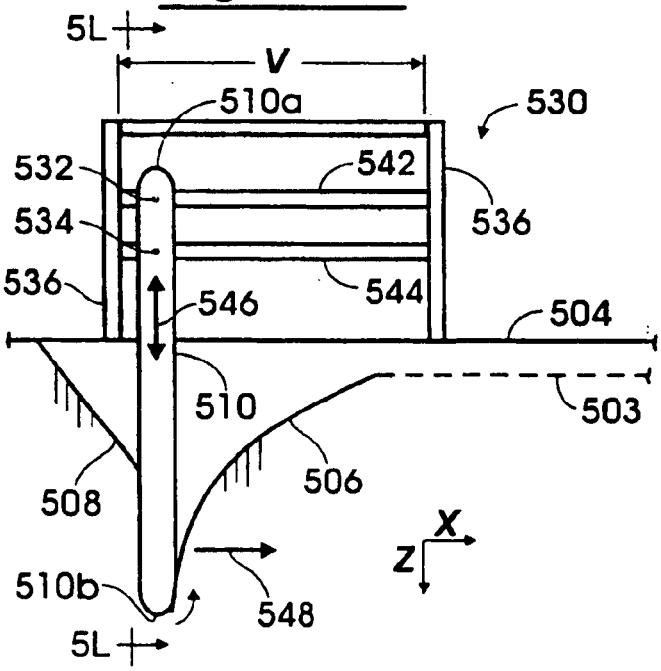

IN SITU MIXING APPARATUS AND METHODS FOR CREATING UNDERGROUND WALL

This application is a continuation of application Ser. No. 09/632,533, filed Aug. 4, 2000, now U.S. Pat. No. 6,470,607.

FIELD OF THE INVENTION

The invention relates to methods and apparatus for constructing underground walls in trenches in the ground, such as soil-cement or slurry cutoff walls (COWs) and, more particularly, to the construction and operation of excavators for forming (excavating, digging) the trenches in the ground.

BACKGROUND OF THE INVENTION

Cutoff walls (COWs) are underground, preferably continuous and typically vertical walls, and may serve both as a foundation (or bearing) wall supporting an overlying structure, such as a pedestrian bridge, and as a diaphragm (or barrier) wall limiting seepage of fluids, such as ground water. Various techniques are known for constructing such underground walls. Very generally, a trench having a generally rectangular section is formed (excavated, dug) in the ground and is filled with cement or a hardening liquid such as cement slurry mixed with excavated earth and sand in the excavated trench to form a soil-cement wall. An exemplary resulting COW wall is also generally rectangular in section, and may have a wide range of dimensions including, but not limited to 100 meters long, 25 meters deep and 1 meter wide (thick).

In a one prior art technique for constructing underground walls, the trench is formed as a number of overlapping, parallel, cylindrical holes which arc drilled vertically into the ground for example, approximately 1 meter diameter holes spaced approximately 0.75 meters center-to-center and extending 25 meters into the ground. Apparatus for drilling and in-situ mixing to construct soil-cement piles (or columns) for soil solidification purposes is well known and shown, for example, in commonly-owned U.S. Pat. No. 5.411,353. Underground walls constructed according to this technique are generally not considered to be "continuous", and are merely cited herein as contextual prior art.

In a prior art technique for constructing underground continuous walls, an excavator comprises an endless chain cutter (also known as a "trenching body"), resembling a chain saw bar and chain, comprising alternating cutter bits and agitator (mixing) bars arranged on an elongate guide post which extends into the ground. The guide post and endless chain are generally similar, but typically larger, than the endless chain and bar of trenchers for burying pipes, cables and the like, such as from Bobcat™ (e.g., the T136 hydrostatic trencher) and Ditch Witch™ (e.g., 1620, 3500). In this technique, the guide post is penetrated vertically into the ground, typically in a hole which has first been dug or drilled into the ground to the desired depth of the resulting wall, and the apparatus is then advanced (moved) slowly in a line along the surface of the ground. The excavated earth (and sand) is mixed with a hardening liquid such as cement slurry, and is injected into the trench behind the endless chain cutter. Examples of this technique may be found in Japanese Patent Publication No. 5-280043 (Document No. 4-79849) and in Japanese Patent Publication No. 5-280044 (Document No. 4-79850). As described in Document No. 4-79850 (at page 4 thereof):

"[An] underground continuous wall construction method . . . comprises the steps of digging a hole in the ground to a predetermined depth by means of a drilling device, inserting the endless chain cutter of the excavator into the hole, and excavating the ground in a predetermined direction by means of the endless chain cutter and removing the excavated earth and sand, while inserting an injection pipe behind the endless chain cutter to jet a hardening liquid mixed with the removed earth and sand into the excavated hole, thereby filling the excavated hole with any one of soil cement and soil mortar."

FIGS. 1A, 1B, and 1C illustrate an excavator 100 of the prior art, which is comparable to the excavator described in the aforementioned Document No. 4-79850. The excavator 100 is for forming a trench 102 in the ground 104 for constructing an underground wall. FIG. 1D illustrates an underground (cutoff) wall 160 being constructed in the trench 102.

A starter hole 108 is dug or drilled vertically into the ground 104, typically to the desired resulting depth D to the bottom 106 of the trench 102 being excavated, typically by means of a boring device such as an earth drill (not shown). An endless chain cutter 110 extends vertically into the hole 108. The endless chain cutter 110 comprises an elongate guide post 112 (or "cutter post"), sprockets 114 and 116 at opposite ends of the guide post 112, an endless chain 120 extending around the guide post 112 and the sprockets 114 and 116, and a number of cutter bits 122 and agitator bars 124 alternately arranged on the endless chain 120. It should be understood that any suitable driving means (not shown) may be provided for driving (rotating) the chain 120, such as in the direction indicated by the arrow 126.

The endless chain cutter 110 is elongate, having a top end 110*a* and a bottom end 110*b*, and having an overall length S which is greater than the desired resulting depth D of the trench 102 being excavated. For example, an endless chain cutter 110 having an overall length S of 30 meters may be disposed in a hole 108 which is only 20 meters deep. Typically, the underground portion of the endless chain cutter 110 is longer than the portion above the ground, so as to ensure stability and reduce the risk of the endless chain cutter 110 falling down.

The endless chain cutter 110 may be made up of several sections which are assembled together, in a known manner. For example, an endless chain cutter 110 having an overall length S of 30 meters may be made up of six sections—each section having a length of 5 meters. The endless chain cutter 110 is typically assembled in a vertical position, inside the hole 108.

The endless chain cutter 110 is generally rectangular in cross section, having cross-sectional dimensions B and H. The cross-sectional dimension B is in the direction of the length L of the trench 102 being dug (excavated), and the cross-sectional dimension H corresponds to the resulting width W of the trench 102. Typically, the dimension B is greater than the dimension H. For purposes of discussion, the chain 120 itself has a width (not labeled) which may be equal to the cross-sectional dimension H of the chain cutter 110.

Evidently, as best viewed in FIG. 1C, the diameter of the hole 108 which is dug into the ground into which the endless chain cutter 110 is disposed, corresponds to and should be slightly larger than the cross-sectional dimension B of the endless chain cutter 110.

With the endless chain cutter 110 inserted into the hole 108 in the ground 104, it is then moved along the X-axis, as indicated by the arrow 138, to create the trench 102 having a length L. This is accomplished by mounting the endless chain cutter 110 in a suitable manner to a trolley 130 which preferably travels on two elongate rails 132 and 134 which are laid, parallel to one another adjacent and parallel to the trench 102 desired to be dug.

The resulting trench 102, and hence the resulting wall 160 being constructed in the trench 102, is in the general form of a three-dimensional rectangular prism having a depth dimension D which is into the ground in the Z-axis, a length dimension L which is along the ground in the X-axis, and a width dimension W which is also along the ground in the Y-axis. The X-, Y- and Z-axes are mutually orthogonal to one another. As best viewed in FIG. 1C, the length L of the trench 102 is typically much larger than the cross-sectional dimension B of the endless chain cutter 110. For example, the trench 102 and resulting wall 160 may be approximately 100 meters long and, as suggested above, approximately 20 meters deep. By way of further example, the width W of the trench 102 may be approximately 0.5–1.0 meters, the cross-sectional dimension H of the endless chain cutter 110 may similarly be approximately 0.5–1.0 meters, and the cross-sectional dimension B of the endless chain cutter 110 may be approximately 1.0–2.0 meters.

It is generally desirable that the resulting wall is not inclined, but rather is substantially vertical and perpendicular to the surface of the ground—in other words, substantially constant Y-axis coordinates along the length of the trench 102. This is indicated by the right angle symbol 136 in FIG. 1B. To accomplish this, the endless chain cutter 110 is secured to the trolley 130 with a tilt mechanism 140. The tilt mechanism 140 comprises a lug 142 extending from (or secured in a suitable manner to) the elongate guide post 112, a corresponding lug 144 extending from a suitable corresponding position on the trolley 130, a pivot pin 146 pivotably connecting the lug 142 with the lug 144, and a suitable mechanism 148 such as a hydraulic actuator for applying force to the endless chain cutter 110 to control its inclination, about a pivot axis 150, as indicated by the arrows 152 and 154. The pivot pin 146 is parallel to the X-axis to control the Y-axis tilt or inclination of the endless chain cutter 110.

As the trench 102 is being excavated, by advancing the endless chain cutter 110 in the X-axis, a hardening liquid such as cement slurry may be jetted into the excavated space behind the endless chain cutter 110, thereby mixing the hardening liquid with the earth (and sand) in the excavated trench to form a soil-cement wall 160, as shown in FIG. 1D.

FIGS. 2A and 2B illustrate, in side and front views, respectively a typical arrangement of alternating cutter bits 122 and agitator bars 124 of a chain 120. These views are essentially magnified views of corresponding portions of the chain 120 shown in FIGS. 1A and 1B, respectively.

For each cutter bit 122, there are a plurality of individual cutter bits 122*a*, 122*b*, 122*c*, 122*d*, 122*e*, 122*f*, 122*g*, 122*h*, 122*i*. 122*j*, 122*k* and 1221, typically identical to one another, an arranged in two rows, each row extending across the cross-sectional dimension H of the endless chain cutter (110) and each row having six cutter bits. Each of the individual cutter bits 122*a*-122*l* is fixed to a base plate 222 which is fixed to a link 220 of the chain 120.

For each agitator bar 124, there are a plurality of individual agitator bars 124*a*, 124*b*, 124*c* and 124*d*, typically identical to one another and suitably arranged in a single row extending across the cross-sectional dimension H of the endless chain cutter (110). Each of the individual agitator bars 124*a*–124*d* is fixed to a base plate 224 which is fixed to a link 220 of the chain 120.

The prior art, as described hereinabove, suffers from a number of shortcomings and problems, including the following:

- A separate/extra piece of equipment, such as earth drill is needed to start the trench, and the starter hole must be drilled to the full depth of the resulting trench. After drilling the starter hole, the earth drill is superfluous.
- It is difficult to assemble the endless chain cutter in a vertical position, which may include assembling it partially within the starter hole.
- It is difficult to control the vertical orientation and tilt of the endless chain cutter while moving it to excavate the trench.
- It is difficult to maintain good balance for the endless chain cutter throughout the trench-excavating operation.
- It is difficult to adjust the endless chain cutter to different trench/wall depths.
- The use of specialized equipment, such as the trolley 130 increases the total cost of the overall system. Also, the total weight and power consumption of the overall system is high.
- The equipment is not readily adapted to any ground surface-condition, and is difficult to achieve consistency with differing ground conditions (hard soil layer, gravel, cobble, boulder, etc.)
- There must be room next to the trench being dug (excavated) for the trolley, which makes it difficult to build a cutoff wall in narrow spaces, such as in the center of a dike having a narrow width.
- At the completion of the trenching operation, it is difficult to remove the endless chain cutter.

SUMMARY OF THE INVENTION

The present invention overcomes the aforementioned, and other deficiencies of the prior art in a number of ways. Generally, and as described in greater detail hereinbelow with respect to preferred embodiments of the invention:

- One piece of equipment such as a common backhoe, serves many purposes in excavating the trench, and obviates the need for a separate/extra piece of equipment, such as earth drill. This reduces the total cost, weight and power consumption of the overall system.
- The endless chain cutter is assembled in a horizontal position, and outside of the trench.
- A guide frame is used which makes it easy to control the vertical orientation and tilt of the endless chain cutter while moving it to excavate the trench, maintain good balance for the endless chain cutter throughout the trench-excavating operation, and adjust the endless chain cutter to different trench/wall depths. The guide frame is also readily adaptable to any ground surface condition, and makes it easy to achieve consistency with differing ground conditions (hard soil layer, gravel, cobble, boulder, etc.). The guide frame straddles the trench being dug (excavated) which makes it easy to build a cutoff wall in narrow spaces, such as in the center of a dike having a narrow width.
- At the completion of the trenching operation, it is easy to remove the endless chain cutter.

According to the invention, methods and apparatuses are provided for constructing an underground wall in a trench, which include:

inventive excavator apparatuses;

inventive endless chain cutters for an excavator; and inventive techniques for assembling and erecting endless chain cutters;

inventive techniques for excavating the trench;

According to an aspect of the invention, an excavator for digging a trench for an underground wall, includes an endless chain cutter having an elongate guide post and multiple chains having cutter bits extending around the guide post. The speed and direction of the chains can individually be controlled as a function of the type of soil being excavated and or as a function of type of cutter bits being used on the chains. For example, a middle one of three chains can be driven at half the speed of the outer two chains. At a given position on the elongate guide post which corresponds to a given depth position of the trench being excavated, the earth at that depth position may be acted upon both by at least one cutter bit on a one of the chains and by at least one agitator bar on another of the chains.

According to another aspect of the invention, a method of excavating a trench for an underground wall comprises cutting deeper in a central portion of the trench than in outer portions of the trench. This can be done with longer cutter bits on a middle one of three chains, or by appropriate profiling of a cutter bit or bits on a single chain. This creates interlocking mortise-tenon type joints between adjacent wall sections, which are more watertight than a conventional butt-type joint, and also results in added stability for the resulting wall.

According to another aspect of the invention, an excavator for digging a trench for an underground wall comprises side gap barriers disposed between the sides of the guide post and the side walls of the trench. The side gap barriers are made of a rugged, flexible material, and are sized and shaped to seal gaps between the sides of the elongate guide post and side walls of the trench and serve to isolate a portion of the trench which is ahead of the elongate guide post from a portion of the trench which is behind the elongate guide post.

According to another aspect of the invention, a novel overall method for constructing a underground wall is provided which includes methods and apparatus for:

(a) digging a "starter" or pre-trench;

(b) assembling an endless chain cutter;

(c) erecting the endless chain cutter in the trench; and (d) excavates the trench.

According to another aspect of the invention, a method of excavating a trench for an underground wall comprises digging a starter trench having a surface sloping from a surface of ground to a bottom of the starter trench, assembling an endless chain cutter in a horizontal position outside of the starter trench, moving the endless chain cutter into the starter trench, erecting the endless chain cutter to a vertical position within the starter trench, and moving the endless chain cutter horizontally song the length of the trench being excavated. A base machine, such as a backhoe which was used to dig the starter trench, may be used to push the endless chain cutter into the starter trench and Erect it to a vertical position. A chain on the endless chain cutter may also be rotated to help move the endless chain cutter into the starter trench.

The trench extends along a Z-axis into the ground, has a length along an X-axis, and has a width along a Y-axis. The endless chain cutter has a pivot pin at a location near its top end. The pivot pin is oriented in the Y-axis to permit articulation of the endless chain cutter in a plane defined by the X- and Z-axes.

The starter trench has an initial depth Which is significantly less than a final depth of the trench being excavated.

With the endless chain cutter in the vertical position, rotating a chain of the endless chain cutter to penetrate the bottom end of the endless chain cutter to the final depth of the trench being excavated.

According to another aspect of the invention, a guide frame is set up around the endless chain cutter and the endless chain cutter is repeatedly moved within the guide frame, then the guide frame is re-positioned until the entire length of the trench has been excavated. Then the guide frame may be removed, and the endless chain cutter de-erected and disassembled. A preferred embodiment of the guide frame comprises vertical legs which are adjustable for leveling the guide frame, horizontal guide beams spaced vertically apart from one another and extending horizontally between the legs, vertical guide beams extending vertically between the horizontal guide beams in a manner that permits the vertical guide beams to move horizontally.

Other objects, features and advantages of the invention will become apparent in light of the following description thereof.

BRIEF DESCRIPTION OF THE DRAWINGS

Reference will be made in detail to preferred embodiments of the invention, examples of which may be illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

FIG. 5J is a simplified side sectional-type view of a next step of the overall method for excavating a trench and constructing the wall, according to the invention.

FIG. 5K is a simplified side sectional-type view of a next step of the overall method for excavating a trench and constructing the wall, according to the invention.

FIG. 5L is a simplified front side sectional-type view of the step illustrated in FIG. 5K, taken on a line 5L—5L through the view of FIG. 5K, according to the invention.

DETAILED DESCRIPTION OF THE INVENTION

Figure 3A:
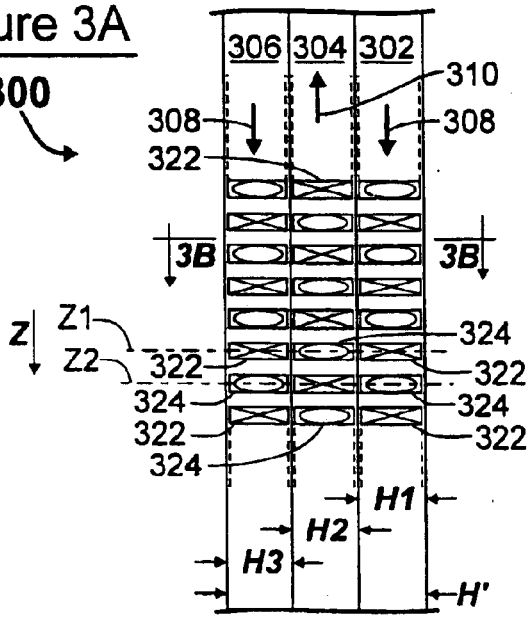
FIG. 3A is a simplified, schematic front view of an endless chain cutter, according to the invention.
Figure 3B:
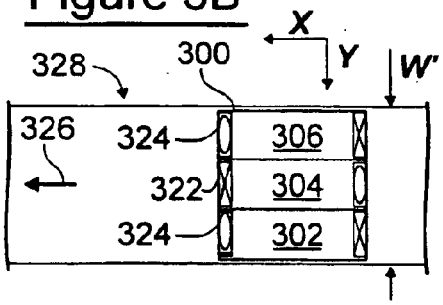
FIG. 3B is a simplified, schematic end sectional view of the endless chain cutter of FIG. 3A, taken on line 3B—3B through FIG. 3A, according to the invention.

An Endless Chain Cutter Having Multiple Chains, the Speeds and Directions of which can be Individually Controlled FIGS. 3A and 3B illustrate an inventive endless chain cutter 300. Whereas the endless chain cutter 110 of the prior art (FIG. 1B) is shown as having one endless chain 120, the endless chain cutter 300 has multiple (at least two) chains, such as three chains 302, 304 and 306. The three chains 302, 304 and 306 are substantially the same length as one another, and are parallel (side-by-side) with one another. Each of the three chains 302, 304 and 306 can be driven by a suitable driving means (not shown) in either direction, (e.g., either up the page or down the page, as illustrated). For example, the two outer chains 302 and 306 can be driven in a direction indicated by the arrows 308, and the middle chain 304 can be driven in an opposite direction, as indicated by the arrow 310. The middle chain 304 is between the two outer chains 302 and 306.

Referring to FIG. 3A, it is shown that each chain 302, 304 and 306 has a width H1, H2 and H3, respectively. In aggregate, the overall width H' of the endless chain cutter 300 is the sum of the three individual chain widths H1, H2 and H3 (H'=H1+H2−H3). These widths H1, H2 and H3 may be the same as one another, or they may be different than one another. For example, the outer two chains 302 and 306 may be narrower (or wider) than the middle chain 304.

According to an aspect of the invention, the multiple chains 302, 304 and 306 of the endless chain cutter 300 can have a greater overall width H' than the width (H) of the prior art endless chain cutter 110 (i.e., H'>H).

Alternatively, the multiple chains 302, 304 and 306 of the endless chain cutter 300 can have a substantially the same overall width H' as the width H of the prior art endless chain cutter 110 (i.e., H'>>H). In this case, the individual chains 302, 304 and 306 can each be narrower than the chain (120) of the prior art endless chain cutter (110), hence typically less expensive. This can be important when replacing parts due to wear or breakage.

According to an aspect of the invention, the speed and direction of each chain 302, 304 and 306 is individually controllable so that not only can each chain be driven in either of two directions (e.g., the two outer chains 302 and 306 in one direction 308 and the middle chain 304 in an opposite direction, 310), but so that each chain 302, 304 and 306 can be driven at an individual speed. For example, the chain 302 can be driven at a speed S1, the chain 304 can be driven at a speed S2 and the chain 306 can be driven at a speed S3. For example, the center chain 304 can be driven at a speed which is slower, such as approximately one-half the speed of each of the outer two chains 302 and 306 (i.e., S2>>S1/2>>S2/2). It is generally preferred that the middle chain 304 be driven at a slower speed and in the opposite direction from the outer two chains 302 and 306 to provide for better mixing of soil and slurry.

An advantage of the present invention is that the speed and direction of each chain can individually be controlled, depending on (as a function of) the type of soil being excavated, which may vary not only from trench-to-trench, but which may also vary along the length of a given trench being excavated for construction of an underground wall. There are many different types and sizes of cutter bits and agitator bars which are known for excavating trenches. The chain speeds can also be controlled depending on (as a function oft) the type of cutter bits and agitator bars being used.

Referring to FIG. 3B, it is generally desirable that the endless chain cutter 300 track straight along the X-axis (e.g., constant Y-axis coordinate), as indicated by the arrow 326 (compare 138), within a trench 328 (compare 102) being excavated. However, it is within the scope of the invention that the endless chain cutter 300 can be "differentially" steered, in the manner of a military tank, for example by driving the one outer chain 302 in the same direction but at a different speed than the other outer chain 306. (Or, for example, by driving the middle chain 304 and one outer chain 302 in a one direction and driving the other outer chain 306 in the opposite direction).

Combinations of Cutting Teeth and Mixing Paddles

According to an aspect of the invention, a plurality of cutter bits (which may also be referred to as "cutting teeth") and agitator bars (which may also be referred to as "mixing paddles" or "paddle blades") are arranged on each of the chains 302, 304 and 306 of the endless chain cutter 300. For example, as shown in FIG. 3A, a plurality of cutter bits 322 (compare 122) and a plurality of agitator bars 324 (compare 124) are alternately arranged on the outer chain 302. In a similar manner, a plurality of cutter bits 322 and a plurality of agitator bars 324 are alternately arranged on the outer chain 306. In a contrasting manner, a plurality of agitator bars 324 and a plurality of cutter bits 322 are alternately arranged on the middle chain 304.

Figure 2A:
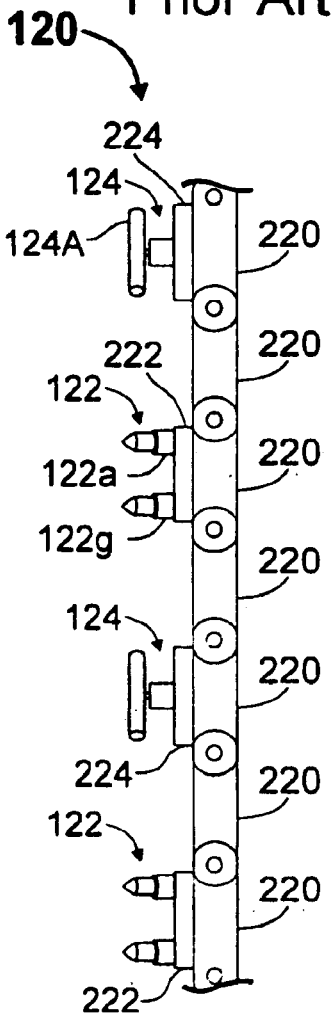
Figure 2A Prior Art
FIG. 2A is a simplified, more detailed (magnified) side view of the cutter bits and agitator bars shown in FIG. 1A, of the prior art, and is comparable to FIGS. 4*c* and 5*c* of the aforementioned Document No. 4-79850.
Figure 2B:
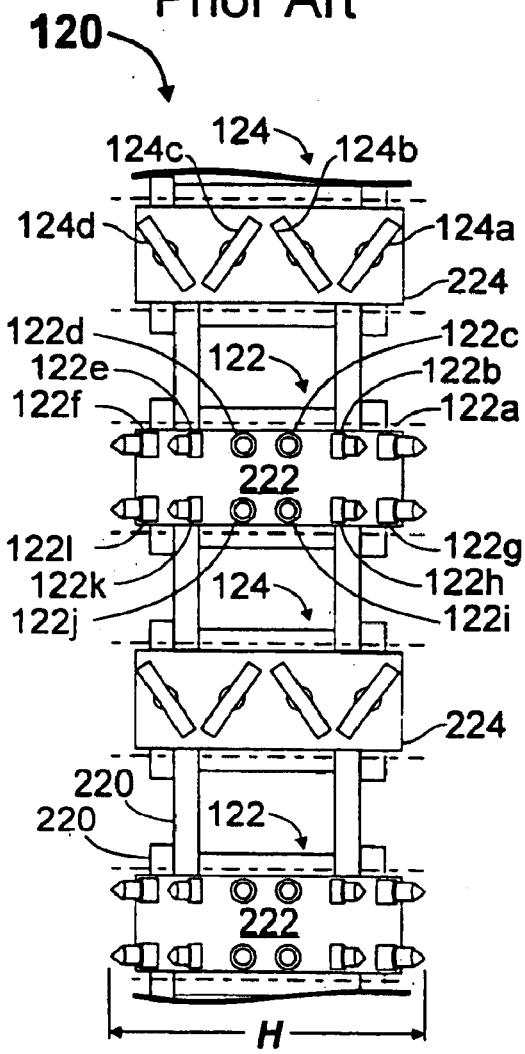
Figure 2B Prior Art
FIG. 2B is a simplified, more detailed (magnified) front view of the cutter bits and agitator bars shown in FIG. 2A, of the prior art, and is comparable to FIGS. 4*b* and 5*b* of the aforementioned Document No. 4-79850.

In the endless chain cutter 110 of the prior art, a plurality of cutter bits 122 are alternately arranged with a plurality of agitator bars 124 so that at any given Z-axis (trench depth position) coordinate there would be either a cutter bit 122 or an agitator bar 124. Even though, as described with respect to FIGS. 2A and 2B, each cutter bit 122 may comprise a plurality of individual cutter bits (122*a*–122*l*), and each agitator bar 124 may comprise a plurality of individual agitator bars (124*a*–124*d*), nevertheless at any given depth position in the trench being excavated, the earth at that depth position is being acted upon either by a cutter bit or by an agitator bar, not by both According to the invention, the earth at a given position on the elongate chain cutter (i.e., on the elongate guide post) which corresponds to a given depth position in the trench being excavated may be acted upon both by at least one cutter bit and by at least one agitator bar. For example, at the depth position indicated by the line Z1, the earth in the trench is being acted upon by a cutter bit 322 of the outer chain 302, by a cutter bit 322 of the outer chain 306, and by an agitator bar 324 of the middle chain 304. For example, at the depth position indicated by the line Z2, the earth in the trench is being acted upon by an agitator bar 324 of the outer chain 302, by an agitator bar 324 of the outer chain 306, and by a cutter bit 322 of the middle chain 304. A vast variety of configurations, or combinations of cutter bits (cutting teeth) and agitator bars (mixing paddles) are thus made possible. This is illustrated in the following TABLE wherein for a given "row" or Z-axis position of the endless chain cutter there is either a cutter bit, an agitator bar or no bit/bar on each of the chains 302, 304, 306 at that Z-axis position.

TABLE

| | Chain 306 | Chain 304 | Chain 302 |
|---|---|---|---|
| Row 1 | cutter | cutter | cutter |
| Row 2 | cutter | cutter | agitator |
| Row 3 | cutter | agitator | cutter |
| Row 4 | cutter | agitator | agitator |
| Row 5 | agitator | agitator | agitator |
| Row 6 | agitator | agitator | cutter |
| Row 7 | agitator | cutter | agitator |
| Row 8 | agitator | cutter | cutter |
| Row 9 | cutter | none | cutter |
| Row 10 | none | cutter | none |
| Row 11 | agitator | none | agitator |
| Row 12 | none | agitator | none |
| Row 13 | none | none | none |

It is generally preferred that configurations having lateral symmetry are employed, for example the configurations shown in Rows 1, 3, 5, 7, 9, 10, 11, 12 and 13 in the TABLE presented above. Generally, each of the chains 302, 304 and 306 should have at least one cutter bit, somewhere along its length, so that it can perform an excavating function.

With regard to this, and other embodiments of the invention, it is within the scope of the invention that various types of cutter bits (cutting teeth) can be employed, including "star" style cutting teeth that are freely rotating.

Profiles of Cutting Teeth

Typically, the endless chain cutter 110 of the prior art will make a cut that is substantially straight across (in the Y-axis) the trench 102. In other words, as the endless chain cutter 110 advances in the X-axis direction, the "leading edge"of "front wall" of the trench 102 being excavated will be flat. The bottom surface 106 of the trench 102 will also be flat. This is because the cutter bit 122 (including 122*a*–122*l*) are typically all the same as one another on a given chain.

Figure 3C:
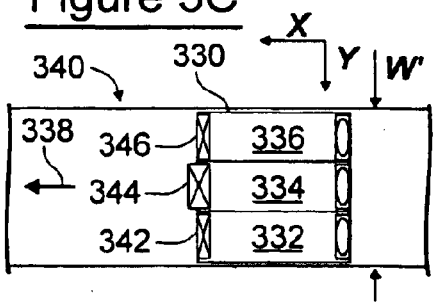
FIG. 3C is a simplified, schematic end sectional view of an alternate embodiment of the endless chain cutter of FIG. 3A, according to the invention.

According to the invention, the cutter bits of an endless chain cutter for a trench excavator are profiled so that they cut deeper in a central (widthwise) portion of the trench as contrasted with outer (lateral) portions of the trench FIG. 3C illustrates an incentive endless chain cutter 330 which is similar to the previously-described endless chain cutter 300 in that it comprises three chains 332, 334 and 336 which are substantially the same length has one another and parallel with one another, and which can independently be driven at a selected speed and in a selected direction. Generally, the endless chain cutter 330 is illustrated as being, as moving in the X-axis, within a trench 340 (compare 102) being excavated, as indicated by the arrow 338 (compare 138). Each chain 332, 334, 336 is shown as having a cutter bit 342, 344, 346, respectively, on its leading (left, as viewed) edge at a selected Z-axis position, in a manner such as is described with respect to Row 1 in the TABLE presented hereinabove. As illustrated, the cutter bit 344 of the middle chain 334 is longer, in the X-axis which is in the direction of the length of the trench 340 being excavated, than the cutter bits 342 and 346 of the outer two chains 332 and 336, respectively. Hence, the cutter bit 344 will cut deeper than the cutter bits 342 and 346. For example, the cutter bit 344 of the middle chain 334 may have a length of 0.30 meters, and the cutter bit 342 and 346 of the outer two chains 332 and 336, respectively, may have a length of only 0.15–0.20 meters, in which case the cutter bit 344 is 50–100% longer than the cutter bits 342 and 346. Therefore, the trench 336 will be excavated deeper in a central portion thereof than at the outer portions thereof, both in the leading edge wall of the trench as well as in the bottom of the trench.

Figure 3D:
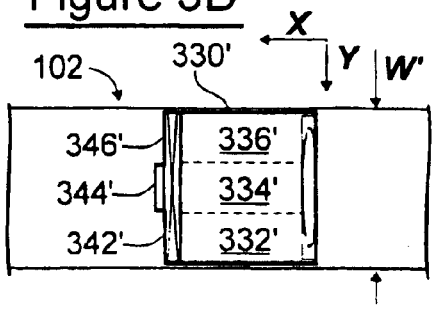
FIG. 3D is a simplified, schematic end sectional view of an alternate embodiment of an endless chain cutter, according to the invention.

FIG. 3D illustrates an alternate embodiment of the invention wherein the endless chain cutter 330' comprises only a single chain having three portions 332', 334' and 336', rather than three individual chains (332, 334, 336) as described hereinabove With respect to the endless chain cutter 330 of FIG. 3C. In this example, a cutting tooth has three portions 342', 344' and 346', and a central portion 344' of the cutting tooth is longer than the outer portions 342' and 346' of the cutting tooth rather than having a longer tooth (344) between two shorter teeth (342, 346) as described hereinabove with respect to the endless chain cutter 330 of FIG. 3C.

Interlocking Wall Sections

When constructing an underground slurry wall, with techniques such as have been described hereinabove, it is common that the slurry wall is not formed continuously, but rather that there are work stoppages, resulting in the overall wall being constructed one section at a time. During the pauses in the work, the slurry may harden, resulting in there being joints between adjacent sections of the slurry wall. Since the slurry wall may serve a function as a diaphragm (or barrier) wall limiting seepage of fluids, such as ground water, the presence of joints is somewhat problematic.

According to the invention, the techniques of profiling the cutter bits of an endless chain cutter for a trench excavator so that they cut deeper in a central (widthwise) portion of the trench as contrasted with outer (lateral) portions of the trench results in a superior, more watertight joint between adjacent sections of slurry wall.

Figure 3E:
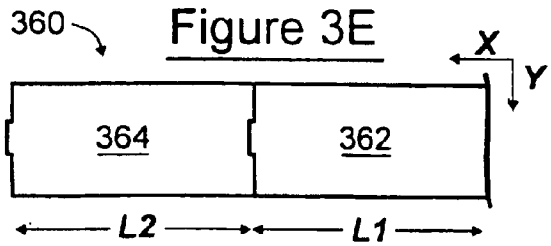
FIG. 3E is a simplified, schematic end sectional view of two section of a wall constructed with the apparatus of the present invention.

FIG. 3E illustrates, in end view, two adjacent sections 362 and 364 of a cutoff wall 360 (compare 160) constructed using the inventive technique of excavating the trench (340) deeper in a central portion of the trench 340 than in outer (lateral) portions thereof, as described hereinabove with respect to FIGS. 3C and 3D. As is evident from this figure, the two adjacent wall sections 362 and 364 are joined by an "interlocking" joint, such as a mortise and tenon type joint or a tongue and groove type joint. As mentioned above, the resulting interlocking joint between adjacent wall sections will be more watertight than a conventional butt-type joint. It will also be a stronger joint. Furthermore, as described in greater detail hereinbelow (e.g., with respect to FIG. 5N), the bottom surface of the trench will also be grooved, resulting in added stability for the resulting slurry wall.

Side Gap Barrier and Method of Mixing

Figure 4A:
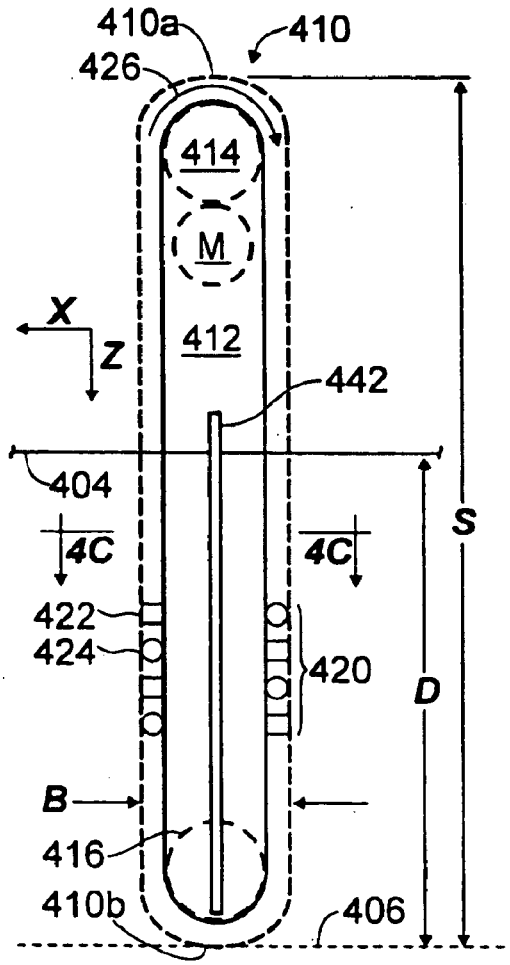
FIG. 4A is a simplified, schematic side view of an alternate embodiment of an endless chain cutter, according to the invention.
Figure 4B:
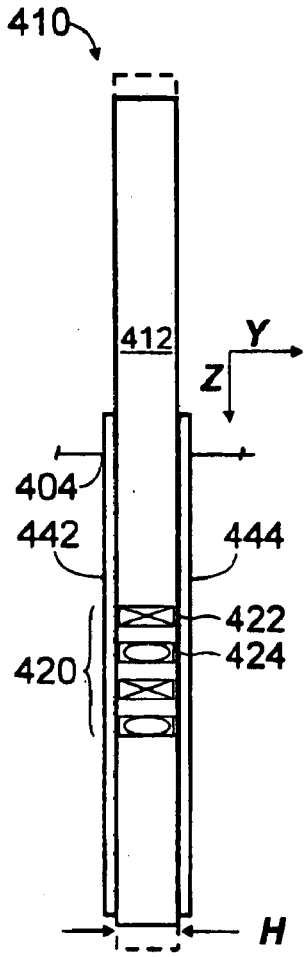
FIG. 4B is a simplified, schematic front view of the endless chain cutter of FIG. 4A, according to the invention.
Figure 4C:
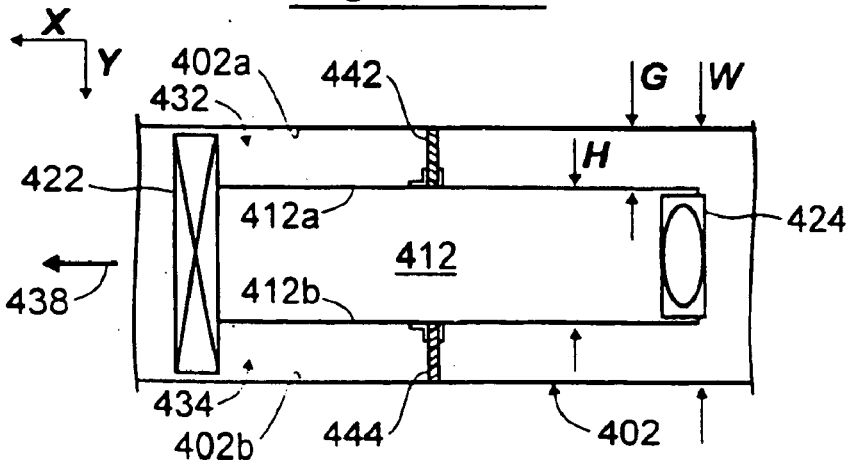
FIG. 4C is a simplified, schematic end sectional view of the endless chain cutter of FIG. 4A, taken on line 4C—4C through FIG. 4A, according to the invention.

FIGS. 4A, 4B and 4C illustrate an alternate embodiment of an inventive endless chain cutter 410 for forming a trench 402 in the ground 404 for constructing an underground walls. For purposes of illustrative clarity, the endless chain cutter 410 will be described as being for the most part similar to the endless chain cutter 110 of the prior art in that it has a top end 410*a* and a bottom end 410*b*, comprises an elongate guide post 412, sprockets 414 and 416 at the opposite ends 410*a* and 410*b* of the guide post 412, an endless chain 420 extending around the guide post 412 and the sprockets 414 and 416, and a number of cutter bits 422 and agitator bars 424 arranged on the endless chain 420. The endless chain cutter 410 may be made up of several sections which are assembled together, in a known manner. The endless chain cutter 410 inserted in the ground 404 and is advanced (moved) along the X-axis, as indicated by the arrow 438, to create the trench 402. In this figure, a suitable driving means M is illustrated for driving (rotating) the chain 420, such as in the direction indicated by the arrow 426.

It is useful, for contrast and clarity, to employ similar exemplary dimensions for describing the endless chain cutter 410 as were used for describing the endless chain cutter 110. For example, the endless chain cutter 410 may have an overall length S of 30 meters and may be made up of six sections—each section having a length of 5 meters. The desired resulting depth D of the trench 102 being excavated may be 20 meters.

The endless chain cutter 410, which is typically rectangular in cross section, has a cross-sectional dimension B in the direction of the length L of the trench 402 being dug, and a cross-sectional dimension H which corresponds to the width W of the trench 402 being dug. The cross-sectional dimensions B and H are suitably approximately 1.0–2.0 meters and 0.5–1.8 meters, respectively, as set forth above in the example of the endless chain cutter 110.

As shown in FIG. 4C, the guide post 412 has two opposite sides 412*a* and 412*b*, and the trench 402 has two opposite side walls (or surfaces) 402*a* and 402*b*. It is also shown in this figure that the cutting bit(s) 422 may be wider than the guide post 412. This will result in there being a gap (space) 432 between the side 412*a* of the guide post 412 and the corresponding side wall 402*a* of the trench 402, and a comparable gap (space) 434 between the side 412*b* of the guide post 412 and the corresponding side wall 402*b* of the trench 402. These gaps 432 and 434 each have a dimension G, which is essentially the width W of the trench 432 minus the cross-sectional dimension H of the guide post 412, divided by two (i.e., $G=(W-H)/2$).

According to an aspect of the invention, side gap barriers 442 and 444 are provided (disposed) between the sides 412*a* and 412*b* of the guide post 412 of the endless chain cutter 410 and the respective side walls 402*a* and 402*b* of the trench being excavated. These side gap barriers 442 and 444 are preferably made of a flexible, yet rugged material such as rubber, neoprene or the like, which may be reinforced with cords in a manner similar to that of pneumatic tires. The side gap barriers 442 and 444 are sized and shaped to function in a manner analogous to the "wings" on a window air-conditioning unit in that they seal the gaps 432 and 434, and isolate a portion of the trench 432 which is ahead of the guide post 412 of endless chain cutter 410 from a portion of the trench 432 which is behind the guide post 412 of the endless chain cutter 410. For example, the portion of the trench 432 which is ahead of the endless chain cutter 410 may contain fresh slurry, in which case it is generally desirable to prevent this slurry which is being mixed by the endless chain cutter 410 from flowing back into the finished portion of the trench (i.e., from flowing back behind the endless chain cutter). The side gap barriers 442 and 444 may extend only partially into the trench 432—for example, only ⅓ to ½ the distance into the trench from the surface of the ground 404.

Method and Apparatus for Erecting an Endless Chain Cutter for Excavating a Trench As discussed hereinabove, in the prior art it is known to commence the excavation of a trench by boring a hole vertically into the ground to the desired resulting depth D of the trench being excavated. This requires the use of a boring device such as an earth drill. It is also known to insert an endless chain cutter, vertically into in the hole which has been bored into the ground, or assembly the endless chain cutter section-by-section, vertically, in the hole in the ground—for example, assembling a one section of the endless chain cutter, lowering it into the hole in the ground, assembling another section of the endless chain cutter to the section which is already in the ground, etc, in which case the sections which are already in the hole in the ground must be suspended in the hole and are not readily accessible for inspectable. According to the invention, a novel overall method for constructing a underground wall is provided which includes methods and apparatus for:

(a) digging a "starter" or pre-trench;

(b) assembling an endless chain cutter;

(c) erecting the endless chain cutter in the trench; and (d) excavating the trench.

Figure 5B:
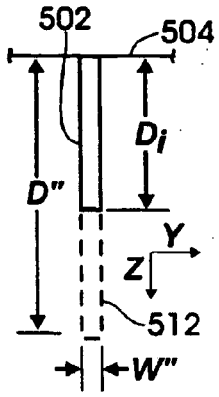
FIG. 5B is a simplified front side sectional-type view of the step illustrated in FIG. 5A, taken on a line 5B—5B through the view of FIG. 5A, according to the invention.
Figure 5A:
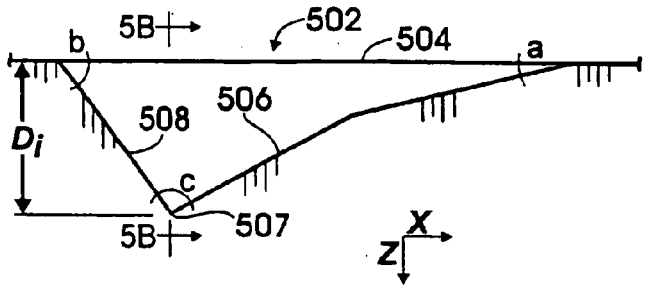
FIG. 5A is a simplified side sectional-type view of a first step of an overall method for excavating a trench and constructing a wall, according to the invention.

FIGS. 5A and 5B are front and side views, respectively of a first step of the overall method for constructing the wall, comprising digging a starter trench 502. The starter trench 502 is excavated in the ground 504, such as with a conventional backhoe machine (not shown) or bulldozer (not shown). The starter trench 502 has an "initial" depth Di which is significantly less than, preferably approximately half of the final depth D" of the resulting trench 512 (shown in dashed lines in FIG. 5B), and has a width W" which is approximately the width of the resulting trench 412. For example:

the initial depth Di is approximately 10 meters;

the final depth D" is approximately 20 meters;

the width W" is approximately 0.5–1.0 meters.

The starter trench 502 preferably has a surface 506 extending from the surface of the ground 504 to the bottom of the starter trench 502, for example at an angle a of approximately 30 degrees with respect to the surface of the ground 504. As will be evident, this "sloped" surface 506 functions as a ramp for facilitating inserting an endless chain cutter into the starter trench 402. The starter trench 502 has another surface 508 extending from the surface of the ground 504 to the bottom of the starter trench 502, for example at an angle b of approximately 60 degrees with respect to the surface of the ground 504. The surfaces 506 and 508 intersect one another at a point 507 which is at the bottom of the starter trench 502 at an angle c, which is suitably approximately 90 degrees. There is thus formed a "crotch" at the initial depth of Di below the surface of the ground, at the bottom of the starter trench 502, the purpose of which will become apparent in the following steps.

The resulting trench 512, and hence the resulting wall which will be constructed in the trench 512, will be in the general form of a three-dimensional rectangular prism having a depth dimension D" which is into the ground in the Z-axis, a length L" (shown in FIGS. 5N, 5O and 5P) which is along the ground in the X-axis, and a width W" which is also along the ground in the Y-axis. The X, Y and Z axes are mutually orthogonal to one another, and are illustrated in FIGS. 5A and 5B.

Figure 5D:
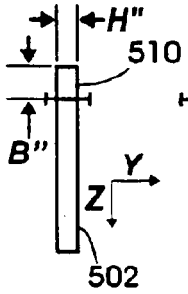
FIG. 5D is a simplified front side sectional-type view of the step illustrated in FIG. 5C, taken on a line 5D—5D through the view of FIG. 5C, according to the invention.
Figure 5C:
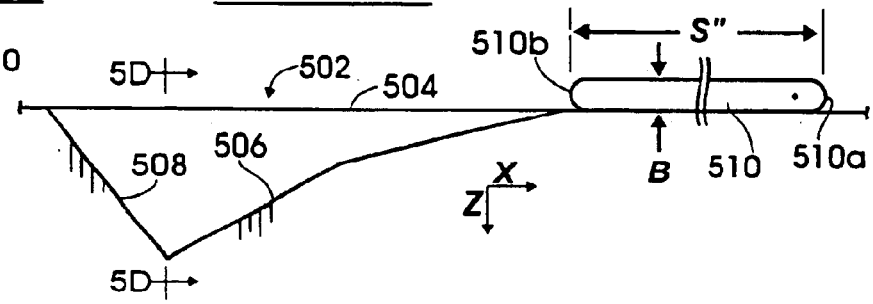
FIG. 5C is a simplified side sectional-type view of a next step of the overall method for excavating a trench and constructing a wall, according to the invention.

FIGS. 5C and 5D illustrate a next step of the overall method for constructing the wall, comprising assembling an endless chain cutter 510 (compare 110) having an overall length S" and cross-sectional dimensions B" and H" for excavating the resulting trench. The endless chain cutter 510 is assembled, in a horizontal position, outside of the starter trench 502. The endless chain cutter 510 may be made up of several segments, in a known manner. For example, an endless chain cutter 510 extending having an overall length S" of 30 meters may be made up of six sections each having a length of 5 meters. The endless chain cutter 510 is elongate and has two opposite ends—a top end 510*a* and a bottom end 510*b*.

It is tremendously advantageous to be able to set up (assemble) the endless chain cutter in a horizontal position and outside of the trench, rather than having to assemble it in a vertical position and, in some cases, within a hole (e.g., 108) that is drilled into the ground. It is simpler, and it is safer.

Figure 5F:
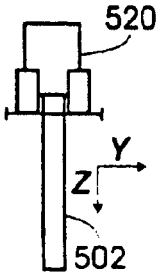
FIG. 5F is a simplified front side sectional-type view of the step illustrated in FIG. 5E, taken on a line 5F—5F through the view of FIG. 5E, according to the invention.
Figure 5E:
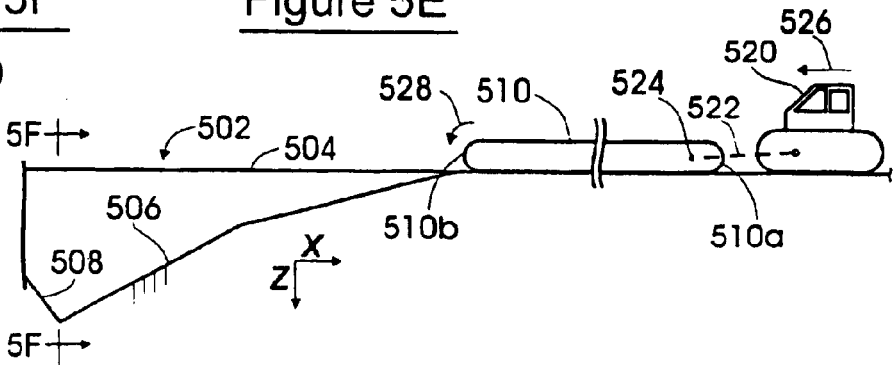
FIG. 5E is a simplified side sectional-type view of a next step of the overall method for excavating a trench and constructing a wall, according to the invention.

FIGS. 5E and 5F illustrate a next step of the overall method for constructing the wall, comprising commencing moving the endless chain cutter 510 into the starter trench 502. A base machine 520, which may be the same backhoe (or bulldozer) which was used to dig the starter trench 502, is connected to the endless chain cutter 510 by a suitable mechanical linkage 522 such as a tow bar or, preferably, an extensible linkage, such as a linkage including a hydraulic actuator (compare 148). The linkage 522 is connected by a pivot pin 524 (or "pin joint") to the endless chain cutter 510, at a location near the top end 510*a* of the endless chain cutter 510, such as 1–2 meters from the top end 510*a* of the endless chain cutter 510. The pivot pin 524 is oriented in the Y-axis and permits articulation of the endless chain cutter 510 in a plane defined by the X- and Z-axes, which is (i.e., will be) the plane of the resulting trench and wall. This, of course, distinguishes the structure, purpose and function of the pivot pin 524 of the present invention from the pivot pin 546 of the prior art discussed hereinabove. As best viewed in FIG. 5F, the base machine preferably "straddles" the starter trench 502. This is preferable to an arrangement wherein the endless chain cutter is supported asymmetrically from only a one side of the trench, such as was shown in FIG. 1B.

The base machine 520 then moves forward, as indicated by the arrow 526, to advance (push, urge) the endless chain cutter 510 towards and into the starter trench 502. At the same time, the chain (not shown, compare 120) or chains (compare 302, 304, 306) of the endless chain cutter 510 can also be slowly rotated, in a direction indicated by the arrow 528, so that the endless chain cutter 510 "creeps" (or "crawls", i.e., moves) under its own power towards (and into) the starter trench 502. In a manner similar to that which was mentioned hereinabove, with respect to the endless chain cutter 300, the endless chain cutter 510 can be "differentially" steered, in the manner of a military tank, for example by driving outer ones of multiple chains at different speeds and/or in opposite directions. In cases where the endless chain cutter 410 moves under its ox al power, the base machine 520 may serve primarily or solely to guide and/or stabilize the endless chain cutter 510.

Figure 5G:
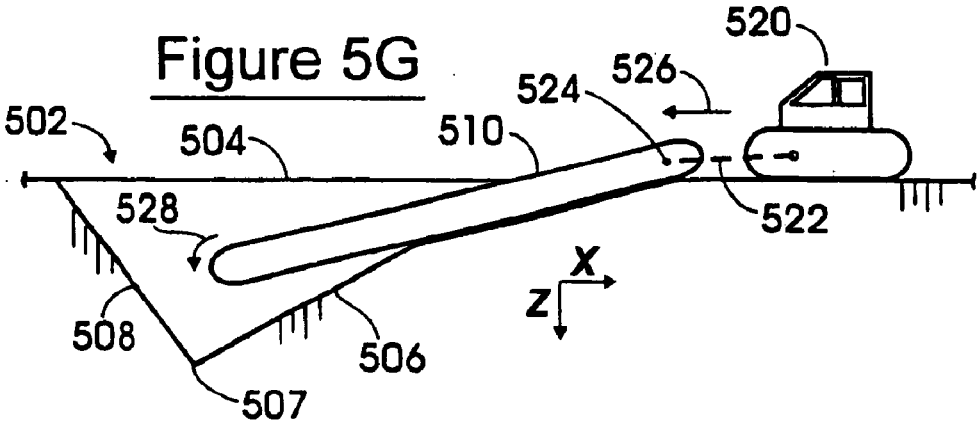
FIG. 5G is a simplified side sectional-tape view, of a next step of the overall method for excavating a trench and constructing a wall, according to the invention.

FIG. 5G illustrates a next step of the overall method for constructing the wall, comprising further advancing the endless chain cutter 510 into the starter trench 502, as indicated by the arrow 526, and commencing erecting the endless chain cutter 510 in the starter trench 502. As illustrated, the endless chain cutter 510 (which is illustrated in this figure in "full"), has partially entered the starter trench 502 and is advancing along the sloped surface 506 towards the bottom of the starter trench 502. As illustrated, the sloped surface 506 of the starter trench 502 may comprise two or more portions having increasing slopes, such as a first portion having a slope of 20 degrees and a second portion having a slope of 30 degrees. Preferably, the chain is still rotating, as indicated by the arrow 528. As indicated in this figure, the endless chain cutter 510 is able to pivot about the pivot pin 524, in the X-Z plane, so that it may "follow" the slope of the surface 506. As will become evident from this figure, and the figures that follow, gravity is advantageously employed to assist in erecting the endless chain cutter 510 from its initial horizontal position (FIG. 5C) to its ultimate vertical position (FIG. 5J) in the starter trench 502.

Figure 5H:
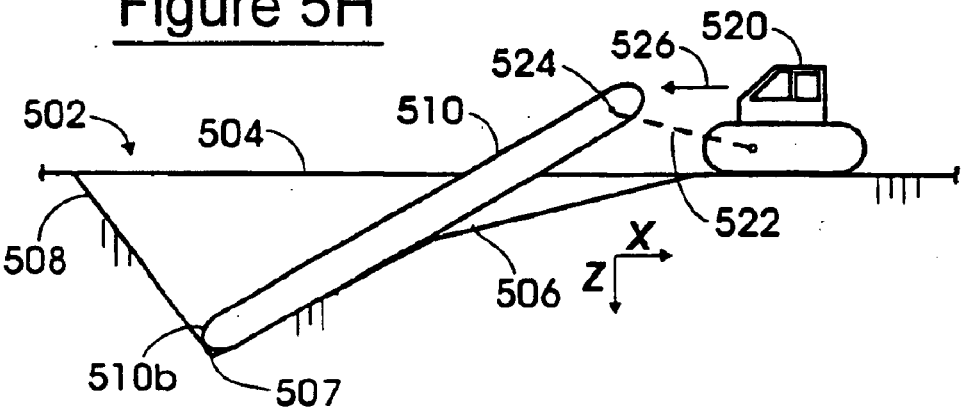
FIG. 5H is a simplified side sectional-type view of a next step of the overall method for excavating a trench and constructing the wall, according to the invention.

FIG. 5H illustrates a next step of the overall method for constructing the wall, comprising further advancing the endless chain cutter 510 into the starter trench 502, as indicated by the arrow 526, and further erecting the endless chain cutter 510 in the starter trench 502. As illustrated, the endless chain cutter 510 is advanced sufficiently that its bottom end 510*b* has butted into the surface 508, and is at the intersection point 507 of the surfaces 506 and 508. As will be evident in the next step, because the bottom end 510*b* of the endless chain cutter 510 is "captured" in the "crotch" at the bottom of the pre-trench, further pushing on the top end 510*a* by the base machine 520, in addition to the weight of the endless chain cutter 510, will readily cause the endless chain cutter 510 to become erected to its ultimate vertical "working" position.

It should be understood that the base machine 520 is shown throughout the figures not-to-scale, for illustrative clarity, and preferably the base machine 520 should be higher overall than the endless chain cutter 510, particularly when the endless chain cutter 510 is erected as illustrated in subsequent figures.

Figure 5I:
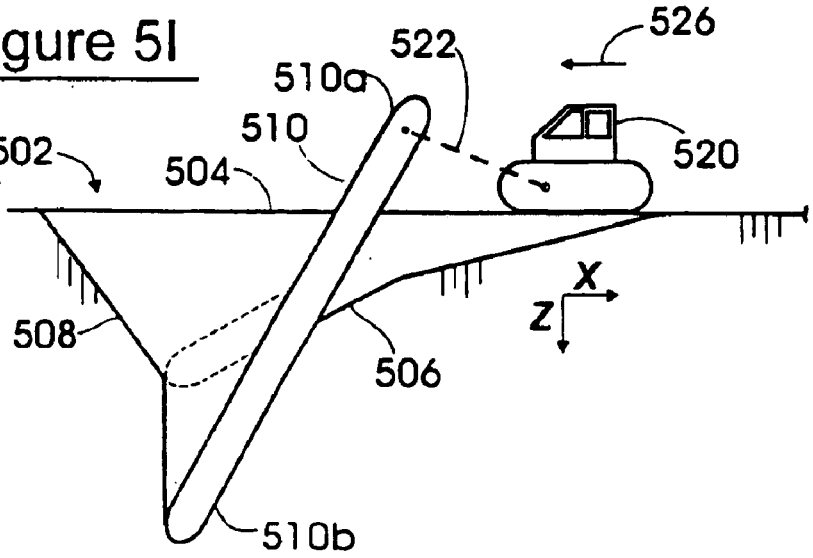
FIG. 5I is a simplified side sectional-type view of a next step of the overall method for excavating a trench and constructing the wall, according to the invention.

FIG. 5I illustrates a next step of the overall method for constructing the wall, comprising further advancing the endless chain cutter 510 into the starter trench 502, as indicated by the arrow 526, and further erecting the endless chain cutter 510 in the starter trench 502. In this step, as illustrated by the dashed lines, the endless chain cutter 510 commences "drilling" into the surface 508 and, as it continues to be erected by movement 526 of the base machine 520 to penetrate in the Z-axis downwards below the bottom of the starter trench 502.

FIG. 5J illustrates a next step of the overall method for constructing the wall, wherein the endless chain cutter 510 has been fully erected to the vertical position and the bottom end 510*b* is well-penetrated into the ground in the bottom of the starter trench 502, such as nearly (but not quite) to the final depth D" of the resulting trench (512). In this figure, both depth dimensions are shown—the initial depth Di of the starter trench 502 and the final depth D" of the trench (512) being excavated. The overall length S" of the endless chain cutter 510 is also illustrated in the figure. At this step, and prior to disconnecting the base machine 520, the chain can be rotated with the endless chain cutter 510 in the vertical position to further penetrate the endless chain cutter 510 into the ground, if desired.

It is thus evident that by having a pin joint 524 disposed near the top end 510*a* of the endless chain cutter 510, and by having a pre-trench with a sloped entrance surface 506, that with the simple expedient of a common backhoe or the like (520), the endless chain cutter 510 can easily be assembled outside of the trench and easily erected to the its vertical working position. This installation procedure makes it easy to install the endless chain cutter to a vertical position without using any drilling equipment, and is also very easy to do in a confined working area, such as atop a dike. Remarkably, the procedure of erecting the endless chain cutter from a horizontal to a vertical position is enabled, in the first instance, simply by digging a shallow trench in the ground (see e.g., FIG. 5A). It is similarly remarkably easy to take the endless chain cutter down from the vertical direction to the horizontal direction upon completing the excavating process, as will become evident from the description that follows (see e.g., FIG. 5Q).

FIGS. 5K and 5L are front and side views, respectively of a next step of the overall method for constructing the wall, comprising building (setting up) a guide frame 530 around the endless chain cutter 510. The endless chain cutter 510 is attached to the guide frame 530 at two points—at one point 532 which is suitably at the location of the pivot pin (524), and at another point (or, with an other pin) 534 which is vertically (in the Z-axis) spaced apart from the first point approximately 1 meter towards the bottom end 510*b* of the endless chain cutter 510. Whereas there was one pin (524) that permitted pivoting of the endless chain cutter 510 during its erection from horizontal to vertical, there are now two pins (532, 534) to secure the endless chain cutter 510 in the vertical position without permitting pivoting. The guide frame 530 is shown only schematically and very generally in these two figures, for illustrative clarity, as comprising four vertical legs 536, each of which may be adjusted in length to ensure that the guide frame 530 is level, irrespective of the terrain, and two horizontal guide beams 542 and 544, extending horizontally across the guide frame, and which are free to move vertically up and down the legs 536. The endless chain cutter 510 is attached at the two points 532 and 534 to the two horizontal guide beams 542 and 544, respectively, so that the endless chain cutter 510 can also be moved vertically up and down, as indicated by the two headed arrow 546. If necessary, the endless chain cutter 510 can be rotated so that it penetrates to the final desired depth D for the trench. As described in greater detail hereinbelow, with respect to a preferred embodiment of the guide frame 530, the endless chain cutter 510 can (in its vertical position) move horizontally along the horizontal guide beams 542 and 544, as indicated by the arrow 548, to excavate the trench 512.

At this stage in the process, with the endless chain cutter erected in the pre-trench and penetrated to the desired depth for the resulting trench, it is preferred to fill the pre-trench with bentonite-cement slurry (not shown), ahead (to the right, as viewed in FIG. 5K) of the endless chain cutter 510. Alternatively, the pre-trench can be filled with a suitable slurry at an earlier step in the overall process. The techniques described herein for excavating the trench and for the erecting the endless chain cutter, including the use of the guide frame, are not dependent upon how or when slurry is introduced into the trench.

The guide frame 530 is preferably maintained stationary, and it is the endless chain cutter 510 that is moved in the X-axis (in the direction of the arrow 548) to excavate the trench 512. The guide frame 530, more particularly the rails 542 and 544 thereof have a length V. This is termed the "working" length of the guide frame 530, as it is the extent that the endless chain cutter 510 can be moved (548) in the X-axis, for excavating the trench 512, while attached to the guide frame 530. In cases where the working length V of the guide frame 530 is less than the desired length L" of the trench, the guide frame 530 must be re-positioned to enable excavating the entire trench.

Figure 5M:
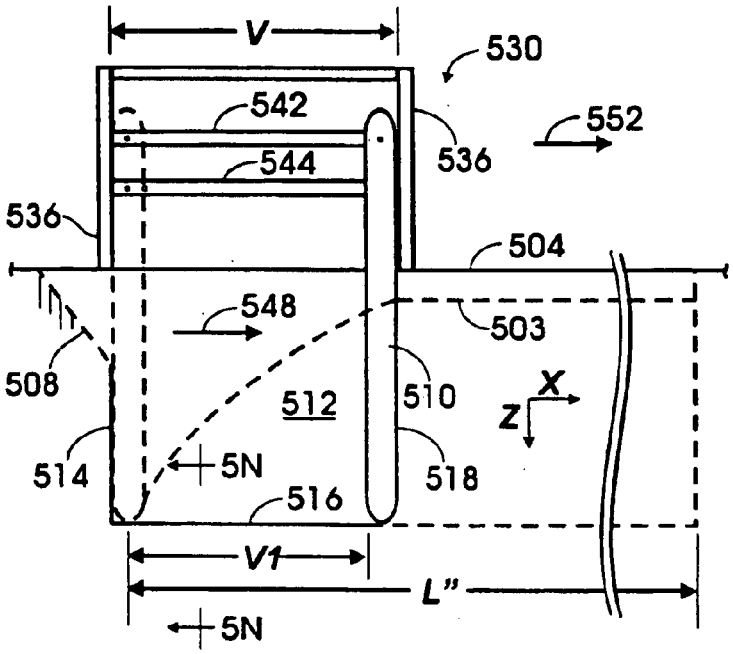
FIG. 5M is a simplified side view, partially sectional, of a next step of the overall method for excavating a trench and constructing the wall, according to the invention.
Figure 5N:
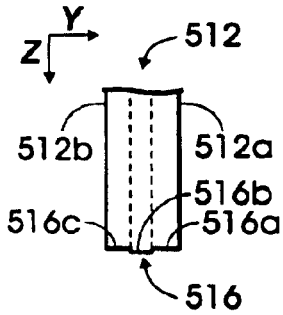
FIG. 5N is a simplified partial side sectional-type view of a portion of the trench shown in FIG. 5M, taken on a line 5N—5N through the view of FIG. 5M, according to the invention.
Figure 5O:
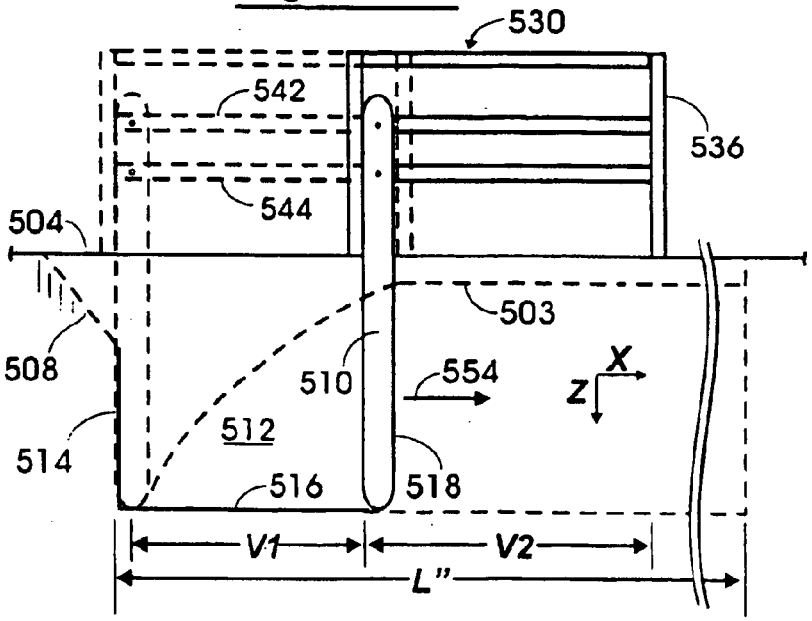
FIG. 5O is a simplified side view, partially sectional, of a next step of the overall method for excavating a trench and constructing the wall, according to the invention.

FIGS. 5M, 5N and 5O illustrate next step of the overall method for constructing the wall, comprising first moving the endless chain cutter 510 within the stationary guide frame 530, then moving the stationary guide frame 530.

FIG. 5M illustrates the guide frame 530 in an initial position, and the endless chain cutter 510 at an initial position (shown in dashed lines) against one end (left, as viewed) of the guide frame 530. The endless chain cutter 510 is then moved in the direction of the arrow 548, to a final position (shown in solid lines) against an opposite end (right, as viewed) of the guide frame 530. In this manner, a portion of the overall length L" of the trench 512 may be excavated. This portion of the trench will have a length of V1 which is approximately equal to the working length V of the guide frame 530. This portion of the trench 512 being excavated will have a one end wall 514 which is where the trench 512 starts, a bottom surface 516 (compare 106), and an opposite end wall 518 that advances as the endless chain cutter 510 moves in the X-axis direction. As best viewed in FIG. 5N, which is a sectional view of the bottom of the trench 512 being excavated, the trench 512 will also have two side walls 512*a* and 512*b* (compare 402*a* and 402*b*). As illustrated in this figure, the bottom surface 516 of the trench 512 may have a central portion 516*b* which is dug deeper than two outer portions 516*a* and 516*b* which are flanking the central portion, as a result of profiling the cutter bits of the endless chain cutter, as discussed hereinabove with respect to FIGS. 3C, 3D and 3E. This "keying in" of the bottom surface 516 of the trench 512 will result in added stability for the wall being constructed within the trench.

When the endless chain cutter 510 has removed within the guide frame 530, the extent (working length) of the guide frame 530, the chain will be stopped, the endless chain cutter 510 will be left in position, and the guide frame 530 itself will be moved to a new position, as indicated by the arrow 552. The guide frame is suitably moved using the same base machine 520 which was used to erect the endless chain cutter 530. In FIG. 5O, the previous position of the guide frame 530 is shown in dashed lines, the current position of the guide frame 530 is shown in solid lines, and the endless chain cutter 510, which was at the extreme right of the guide frame 530 in FIG. 5M is shown in FIG. 5O as being at the extreme left of the guide frame 530 in its current position. The endless chain cutter 510 can then be moved horizontally along the rails 542 and 544, as indicated by the arrow 554 (compare 548), to further excavate a next portion of the trench 512. This next portion of the trench will have a length of V2 which is equal to the length V1 of the previous trench portion and which is approximately equal to the working length V of the guide frame 530. This "indexing" of the position of the guide frame 530 and moving the endless chain cutter 510 within the guide frame 530 can be repeated, as required, until the entire (final) length L" of the trench 512 has been excavated.

While moving the endless chain cutter 510 to excavate the trench, the pre-trench ahead (to the right, as viewed) of the endless chain cutter 510 can be filled with bentonite-cement slurry (not shown). The agitator bars (paddle blades) will move the slurry down to the bottom of the trench, and will also move the soil-slurry mix up from the bottom of the trench. By using different positions, different width and different lengths of paddle blades the slurry flow will be disturbed inside the wall, thereby causing the soil and slurry to mix in-situ.

Figure 5P:
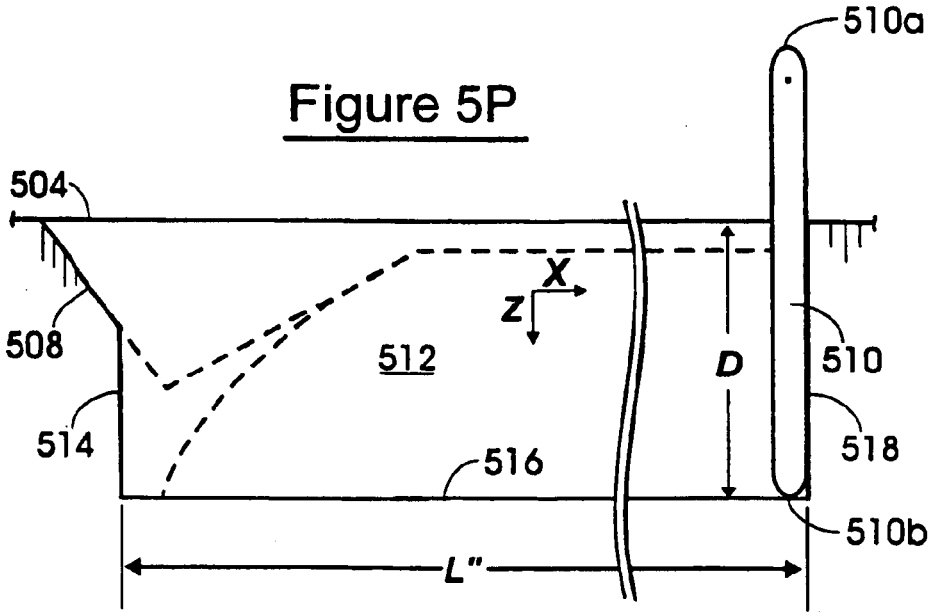
FIG. 5P is a simplified side sectional-type view of a next step of the overall method for excavating a trench and constructing the wall, according to the invention.

FIG. 5P illustrates the resulting trench 512 (compare 102), which defines (serves as a form for) the resulting underground wall (compare 160) being constructed in the trench 512. The trench 512 is in the general form of a three-dimensional rectangular prism having a depth dimension D which is into the ground in the Z-axis, a length dimension L" which is along the ground in the X-axis, and a width dimension (W, not shown) which is also along the ground in the Y-axis (not shown). For example, the trench 512 and resulting wall may be L"=500 meters long and D=20 meters deep, and may be 1 meter wide. The trench excavation having been completed, the guide frame 530 may be disassembled and/or removed.

Figure 5Q:
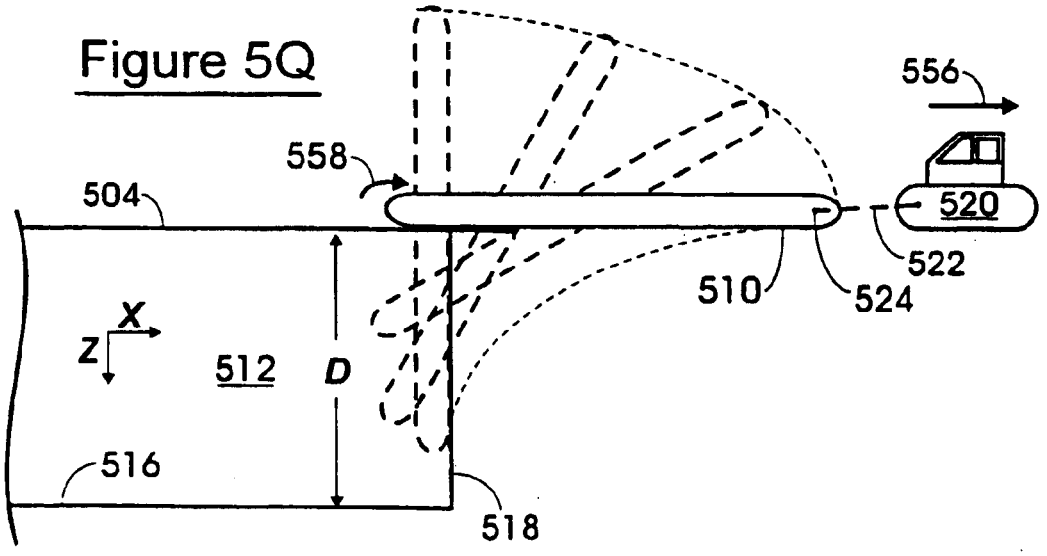
FIG. 5Q is a simplified side sectional-type view of a next step of the overall method for excavating a trench and constructing the wall, according to the invention.

FIG. 5Q illustrates a final step in the overall method for constructing the wall, wherein the base machine 520 is brought back in to remove the endless Pain cutter 510 from the trench. This is done in a manner which can be likened to performing the steps illustrated in FIGS. 5E, 5G, 5H, 5I and 5J—in reverse. More particularly, the base machine 520, which may be the same backhoe (or bulldozer) which was used to dig the starter trench 502, is connected to the endless chain cutter 510 by a suitable mechanical linkage 522 which is connected by a pivot pin 524 to the endless chain cutter 510, at the location near the top end 510*a* of the endless chain cutter 510, such as 1–2 meters from the top end 510*a* of the endless chain cutter 5 As before, the pivot pin 524 is in the Y-axis and permits articulation of the endless chain cutter 510 in a plane defined by the X- and Z-axes, which is (i.e., will be) the plane of the resulting trench and wall. The endless chain cutter 510 may then be uplifted, and pulled out of the trench 512 the base machine 520 moving backwards (away from the trench), as indicated by the arrow 558 to withdraw pull) the endless chain cutter 510 from the trench 512. At the same time, the chain (not shown, compare 120) or chains (compare 302, 304, 306) of the endless chain cutter 510 can also be slowly rotated, in a direction indicated by the arrow 558 (compare 528), so that the endless chain cutter 510 "creeps"(or "crawls") under its own power out of the trench 512. The direction 558 of chain rotation is opposite the direction 528 (FIG. 5G). Generally, this step of the process can be summarized as "de-erecting" the endless chain cutter 510 from its vertical position within the trench 512, to a horizontal position outside of the trench 512, for subsequent dismantling (dis-assembly).

It is significant to note that the base machine, which may suitably be a common backhoe, serves many purposes in the overall construction of the underground (cutoff) wall. It is first used to dig the pre-trench (see e.g., FIG. 5A). Next, it may be used to push the endless chain cutter into the pre-trench (see FIG. 5C) and to erect it therein (see e.g., FIG. 5J). Then it may again be used to re-position the guide frame (see e.g., FIG. 5O). Lastly, it may be used to remove the endless chain cutter from the trench (see e.g., FIG. 5Q). This, of course, contributes greatly to the efficiency and cost-effectiveness of the inventive process(es). Extra equipment is not needed, and the backhoe is the basic equipment to all such construction work, and is typically on-hand (at the work site) anyway.

Referring again to FIG. 5J, once the endless chain cutter 510 is in place, the backhoe may also be used to create and maintain a furrow 503 having a relatively shallow (e.g., 1 meter deep) depth Df that extends ahead (to the right, as viewed) of the endless chain cutter 510. This furrow 503 is suitably used to supply cement slurry (not shown) to the endless chain cutter 510. Generally, the cement slurry will be nixed by the rotation (e.g., clockwise, as viewed) of the chain on the endless chain cutter and will fill the trench behind (to the left, as viewed) the endless chain cutter 510 to create the slurry wall.

Referring again the FIG. 5J, although not specifically illustrated, it should be understood, and it is within the scope of the present invention (e.g., as an alternate embodiment) that the guide frame 530 can be omitted, and the endless chain cutter 510 can be advanced (compare 548, 554) with the base machine 520, by "towing" it with suitable mechanical linkage such as a tow bar (compare 522). The mechanical towing linkage suitably attaches two vertically spaced-apart points (compare 532 and 534) on the endless chain cutter 510 to maintain the endless chain cutter 510 in a substantially vertical orientation during excavation of the trench.

Figure 6B:
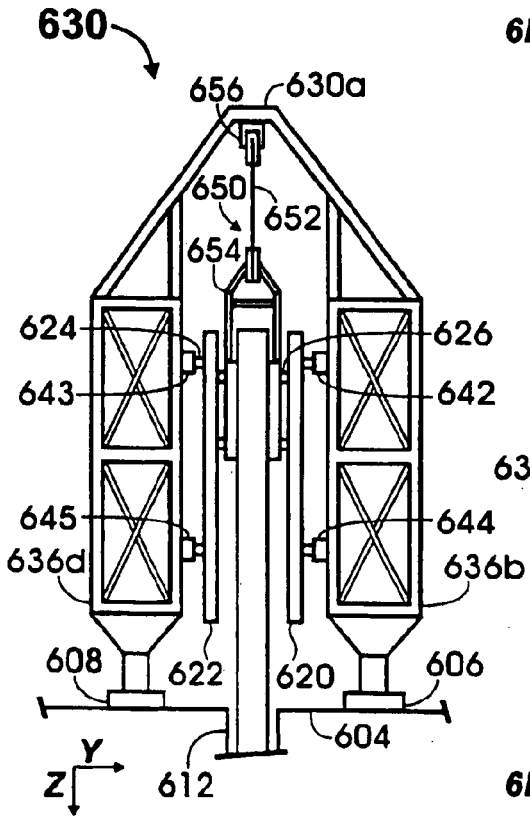
FIG. 6B is a front view of the guide frame of FIG. 6A, taken on a line 6B—6B through the view of FIG. 6A, according to the invention.
Figure 6A:
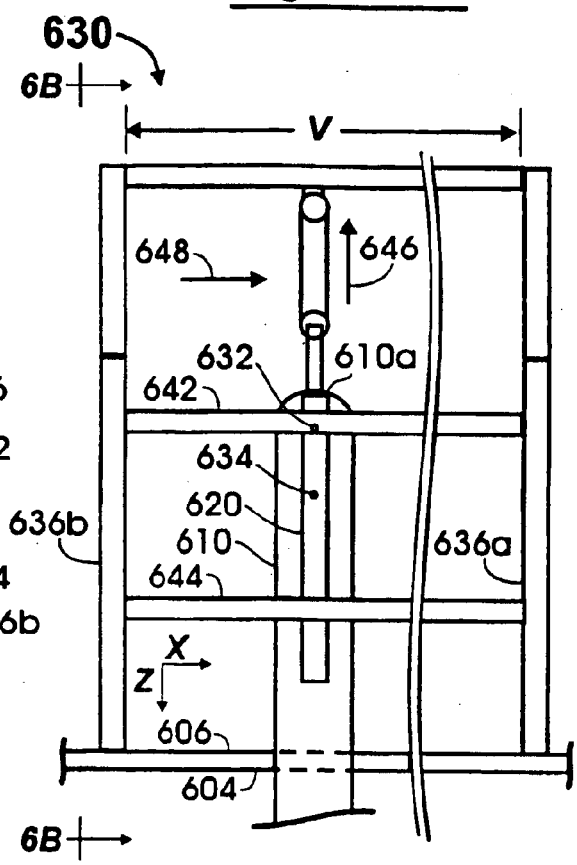
FIG. 6A is a side view of an embodiment of a guide frame, according to the invention.

FIGS. 6A and 6B are side and front views, respectively, of a preferred embodiment of a guide frame 630, such as the guide frame 530 which was shown schematically in FIGS. 5K and 5L, respectively.

The guide frame 630 has four vertical legs (compare 536)—two of which 636*a* and 636*b* are visible the side view of FIG. 6A and form one side of the guide frame 630, and two of which 636*b* and 636*d* are visible in the end view of FIG. 6B and form one end of the guide frame 630. The fourth leg (which would be 636*c*) on the opposite end and opposite side of the guide frame 630 is not visible in either of these views. The vertical legs, collectively referred to by "636", may each be adjusted in length to ensure that the guide frame 630 is level on the ground 604, irrespective of the terrain upon which it rests. Rails 606 and 608 (compare 132, 134) may be provided for facilitating indexing (re-positioning) the guide frame 630, as discussed hereinabove with respect to FIGS. 5M and 5O. As best viewed in FIG. 6B, the guide frame 630 "straddles" the trench 612 being excavated.

It should be understood, and it is within the scope of the invention, that instead of having rails 606 and 608, the legs 636 can each terminate in or stand on "feet", rollers, pads, and the like, including rollers, so that the guide frame 630 can be dragged along the ground by the base machine to be repositioned (moved to a new position along the length of the trench being excavated), as discussed for example with respect to FIG. 5O hereinabove. In such a case, such pads or the like should be sized and shaped so that the feet do not dig into the ground.

The guide frame 630 has a pair of (two) horizontal guide beams 642 and 644 (compare 542 and 544) extending horizontally, in the X-axis, between the two legs 636*a* and 636*b* on the one side of the guide frame 630. The guide beams 642 and 644 are spaced vertically apart from one another. Another pair of guide beams 643 and 645 extend horizontally, in the X-axis, between the two legs 636c (not visible) and 636*d* on the other side of the guide frame 600, and are similarly spaced vertically apart from one another.

A vertical guide beam 620 extends vertically, in the Z-axis, between the pair of horizontal guide beams 642 and 644 Another vertical guide beam 622 extends vertically, in the Z-axis, between the pair of horizontal guide beams 645 and 647. The vertical guide beams 620 and 622 are coupled to the respective pairs of horizontal guide beams with rollers 624, linear bearings or the like, in a manner that permits the vertical guide beams 620 and 622 to traverse horizontally from end-to-end of the guide frame 600, as indicated by the arrow 648 (compare 548). Those skilled in the art will understand that the vertical guide beams 620 and 622 and the endless chain cutter 610 move from end-to-end (left-to-right, as viewed) in response to a conventional mechanical or hydraulic mechanism (not shown).

An endless chain cutter 610 (compare 510) is attached to the vertical guide beams 620 and 622 at two points 632 and 634 (compare 532 and 534) by rollers 626 permitting vertical positioning of the endless chain cutter 610. The two points 632 and 634 are suitably spaced approximately 1 meter (vertically) from one another.

As described hereinbefore, vertical positioning of the endless chain cutter 610 corresponds to the depth of the trench 612 (compare 512) being excavated, and horizontal movement of the endless chain cutter 610 corresponds to the length of the trench 612 being excavated. Also, as described hereinbefore, in cases where the working length V of the guide frame 630 is less than the desired length of the trench 612 being excavated, the guide frame 630 must be re-positioned to enable excavating the entire length of the entire trench 612.

The endless chain cutter 610 is easily raised or lowered, as indicated by the arrow 646 (compare 546) by means of a pulley system 650 including a cable 652 extending between the top 630*a* of the guide frame 630 and the top end 610*a* of the endless chain cutter 610, and suitable brackets 654, 656, and the like. The endless chain cutter 610 is essentially hanging from the top 630*a* of the guide frame 630.

The inventive guide frame (e.g., 530, 630) has numerous advantages over the prior art.

It is very easy to control the vertical orientation (including tilt) of the endless chain cutter (trenching body) while moving it to excavate the trench.

It is very easy to maintain good balance throughout the trench-excavating operation.

It is very easy to adjust to different wall depths.

Figure 1A:
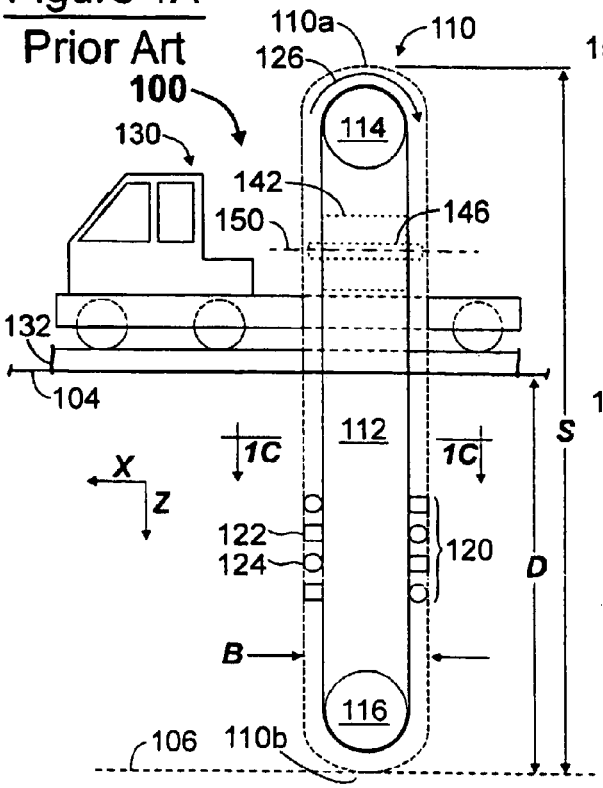
Figure 1A Prior Art
FIG. 1A is a simplified, schematic side view of an excavator of the prior art, and is comparable to FIG. 1 of the aforementioned Document No. 4-79850.
Figure 1B:
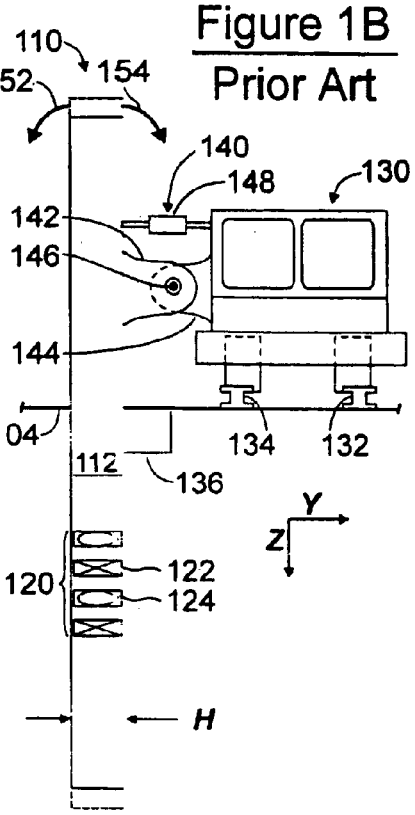
Figure 1B Prior Art
FIG. 1B is a simplified, schematic front view of the excavator of FIG. 1A, of the prior art, and is comparable to FIG. 2 of the aforementioned Document No. 4-79850.
Figure 1C:
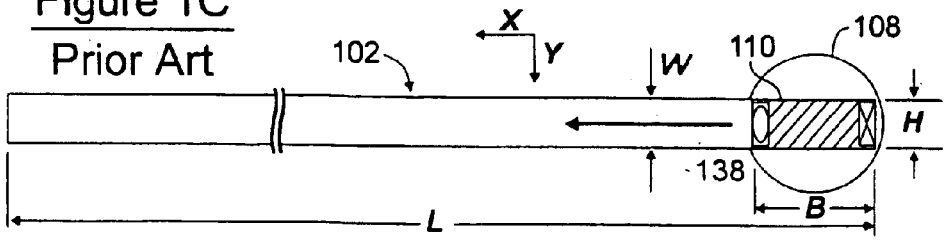
Figure 1C Prior Art
FIG. 1C is a simplified, schematic end sectional view of the excavator of FIG. 1A, of the prior art, taken on line 1C—1C through FIG. 1A, and is comparable to FIG. 6*c* of the aforementioned Document No. 4-79850.
Figure 1D:
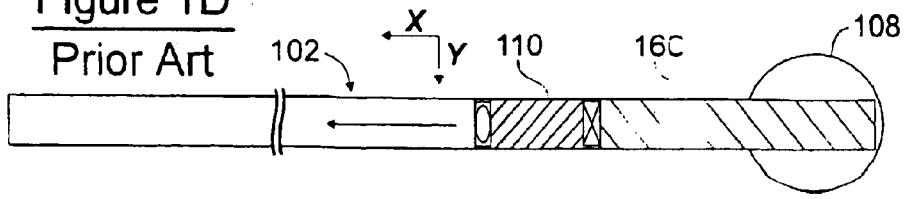
Figure 1D Prior Art
FIG. 1D is a simplified, schematic end sectional view of the excavator of FIG. 1A, of the prior art, taken on line 1C—1C through FIG. 1A, at a later stage in the excavation and wall construction process shown in FIG. 1C.

By using a guide frame which is separate from the base machine (e.g., 520), the total cost of the overall system is reduced, as compared with using one big system such as is shown in FIGS. 1A and 1B. Also, the total weight and power consumption of the overall system can be reduced, compared with using one big system.

The guide frame is readily adapted to any ground surface condition, and also enables consistency irrespective of ground conditions (hard soil layer, gravel, cobble, boulder, etc.)

By using a guide frame which "straddles" the trench being dug, and which is separate from the base machine (e.g., 520), the overall system is more suitable for building a cutoff wall in narrow spaces, such as in the center of a dike having a narrow width.

Having described the present invention with reference to specific embodiments, the above description is intended to illustrate the operation of the preferred embodiments and is not meant to limit the scope of the invention. The scope of the invention is to be limited only by the following claims. From the above discussion, many variations will be apparent to one skilled in the art that would yet be encompassed by the true spirit and scope of the present invention.

What is claimed is:

1. An in situ mixing apparatus for creating an underground wall, comprising:

an elongated guide post; and at least two independently driven chains having cutter or agitator bits, said two independently driven chains extending around the guide post, parallel with one another, a first chain of said two independently driven chains driven in a first direction, and a second of said two independently driven chains driven in a second direction different from the first direction.

2. The in situ mixing apparatus according to claim 1, wherein each of the at least two independently driven chains has a width, and the width of a one of the chains is different than the width of another of the chains.

3. A method of creating an underground wall, comprising:

providing at least two independently driven chains having cutter or agitator bits, said two independently driven chains extending around a guide post, a first chain of said two independently driven chains driven in a first direction, and a second of said two independently driven chains driven in a second direction different from the first direction; and driving the chains while moving the guide post in a direction of a length of the underground wall being created.

4. Method, according to claim 3, further comprising:

driving one of the chains at a first speed; and driving a second of the chains at a second speed which is slower than the first speed.

5. Method, according to claim 4, wherein:

the second speed is approximately half of the first speed.

6. Method, according to claim 4, wherein types of soil are mixed to create an underground wall, further comprising:

controlling at least one of the first and second speeds as a function of the type of soil being mixed.

7. Method, according to claim 4, wherein types of cutter or agitator bits are disposed on the chains, further comprising:

controlling at least one of the first and second speeds as a function of the type of bits being used.

8. Method of creating an underground wall, according to claim 3, wherein there is a middle chain disposed between two outer chains, further comprising:

driving the middle chain at a first speed;

driving at least one of the outer chains at a second speed which is different than the first speed.

9. Method, according to claim 8, wherein the first speed is approximately of the second speed.

10. Method, according to claim 8, further comprising:

driving the middle chain in a first direction; and driving at least one of the outer chains in a second direction which is opposite the first direction.

11. Method of creating an underground wall, according to claim 3, wherein there is a middle chain disposed between two outer chains, further comprising:

at a given position on the elongated guide post, corresponding to a given depth position of a trench being excavated, the earth at that depth position is acted upon both by at least one cutter bit on one of the chains and by at least one agitator bit on another of the chains.

12. Method of creating an underground wall, according to claim 3, comprising:

with an endless chain cutter having cutter bits, cutting deeper in a central portion of a trench than in outer portions of the trench.

13. An in situ mixing apparatus for creating a trench for an underground wall, the trench having two opposite side walls, a top plane, and a bottom plane, the top plane being even with the ground surface, the apparatus comprising:

an elongated guide post having two opposite sides at least two independently driven chains having cutter or agitator bits, said two independently driven chains extending around the guide posts, parallel with one another, a first chain of said two independently driven chains driven in a first direction, and a second of said two independently driven chains driven in a second direction different from the first direction;

side gap barriers disposed between the sides of the guide post and the side walls of the trench, extending from the bottom plane of the trench to at least the top plane of the trench.

14. The Apparatus according to claim 13, wherein:

the side gap barriers are made of a rugged, flexible material.

15. The Apparatus according to claim 13, wherein:

the side gap barriers are sized and shaped to seal gaps between the sides of the elongated guide post and side walls of the trench.

16. The Apparatus according to claim 13, wherein:

the side gap barriers isolate a portion of the trench which is ahead of the elongated guide post from a portion of the trench which is behind the elongated guide post.

17. An in situ mixing apparatus for creating an underground wall, comprising:

a guide frame having a longitudinal length, an elongated guide post adapted to move along the longitudinal length of the guide frame; and, at least two independently driven chains having cutter or agitator bits, said two independently driven chains extending around the guide posts, parallel with one another, a first chain of said two independently driven chains driven in a first direction, and a second of said two independently driven chains driven in a second direction different from the first direction.

18. The Apparatus according to claim 17, wherein the longitudinal length of the guide frame is shorter than the desired underground wall.

19. The Apparatus according to claim 17, wherein the guide frame is positioned to straddle a trench.

20. The Apparatus according to claim 17, wherein the guide frame further contains a plurality of adjustable support legs to allow guide post and chain to move along the longitudinal length in a level path notwithstanding an uneven ground surface.

21. The Apparatus according to claim 20, wherein the guide frame support legs rest on rollers to facilitate repositioning of the guide frame by a base machine.

22. The Apparatus according to claim 20, wherein the guide frame support legs rest on feet adapted to prevent the legs from breaking the surface of the ground.

* * * * *

UNITED STATES PATENT AND TRADEMARK OFFICE

CERTIFICATE OF CORRECTION

PATENT NO. : 6,925,736 B2
DATED : August 9, 2005
INVENTOR(S) : Osamu Taki

It is certified that error appears in the above-identified patent and that said Letters Patent is hereby corrected as shown below:

Column 21,
Line 18, please insert -- "half" -- after "approximately]".

Signed and Sealed this

Twenty-ninth Day of November, 2005

JON W. DUDAS
*Director of the United States Patent and Trademark Office*